United States Patent [19]

Goodall

[11] Patent Number: 4,509,665

[45] Date of Patent: Apr. 9, 1985

[54] POURING DEVICE

[76] Inventor: Donald T. Goodall, 30 Beach St., Blakehurst, N.S.W. 2220, Australia

[21] Appl. No.: 577,017

[22] Filed: Feb. 6, 1984

Related U.S. Application Data

[63] Continuation of Ser. No. 325,424, filed as PCT AU81/00033, Mar. 23, 1981, published WO 81/02720, Oct. 1, 1981, § 102(e) date Nov. 23, 1981, abandoned.

[30] Foreign Application Priority Data

Mar. 21, 1980 [AU] Australia ..... PE2869
Nov. 13, 1980 [AU] Australia ..... PE6486

[51] Int. Cl.[3] ..... B65D 25/48; B65D 51/16
[52] U.S. Cl. ..... 222/478; 222/569
[58] Field of Search ..... 222/478, 567, 569, 568, 222/570, 573

[56] References Cited

U.S. PATENT DOCUMENTS 1,952,288 3/1934 Saxon ..... 222/569
2,825,495 3/1958 Fazio ..... 222/478
2,915,223 12/1959 Beall, Jr. ..... 222/478 X
3,506,167 4/1970 Orr ..... 222/569 X

FOREIGN PATENT DOCUMENTS 3042169 9/1982 Fed. Rep. of Germany ..... 222/569
1534069 7/1968 France ..... 222/569

*Primary Examiner*—Joseph J. Rolla
*Assistant Examiner*—Kevin P. Shaver
*Attorney, Agent, or Firm*—Emory L. Groff, Jr.

[57] ABSTRACT

A pouring device which is fixed into the outlet of a liquid container. The device has a main portion and bifurcated legs which conform to the internal shape of the container outlet. A vent tube provides access for air forced into the container by the low pressure zone therein created by the outflow of liquid. The area between the legs constitutes the outlet path for a continuous stream of liquid from the container. The legs are spaced apart to facilitate mounting of the device in the container outlet.

5 Claims, 5 Drawing Figures

POURING DEVICE

This is a continuation of application Ser. No. 325,424, filed as PCT AU 81/00033, Mar. 23, 1981, published WO 81/02720, Oct. 1, 1981, § 102(e) date Nov. 23, 1981, now abandoned.

This invention relates to a pouring device and more particularly to a pouring device for use with a liquid container.

It is well known that it is difficult, if not impossible, to obtain a smooth flow of liquid from a container having a single outlet. The outflow of liquid from the container creates a low pressure zone within the container. As a consequence of this, air is forced into the container through the liquid passing through the outlet and in so doing creates a surging or gulping effect. This surging effect disrupts the outflow producing an unstable jet of liquid.

In normal circumstances, such an unstable jet of liquid iis merely inconvenient. However, when corrosive, toxic or flammable liquids are being poured from a container such an unstable outflow can be extremely dangerous.

It is an object of this invention to provide a pouring device for a liquid container which will enable a smooth outflow of the liquid to be obtained.

According to the invention there is provided a pouring device adapted to be positioned in the outlet of a container, said device comprising:

(i) a body portion having a front face and a rear face which when the device is in position in the outlet faces the interior of the container, (ii) an aperture through the body portion from the front face to the rear face, (iii) an air-flow tube extending from the rear face of the body portion and in communication with the aperture so that air may flow from the exterior of the container to the interior of the container, and, (iv) a pair of opposed legs extending from the body portion which generally conform to the shape of the container outlet but which are spaced apart at their ends remote from the body portion, the area between the legs defining an outlet path through which liquid from the container may flow.

Figure 1:
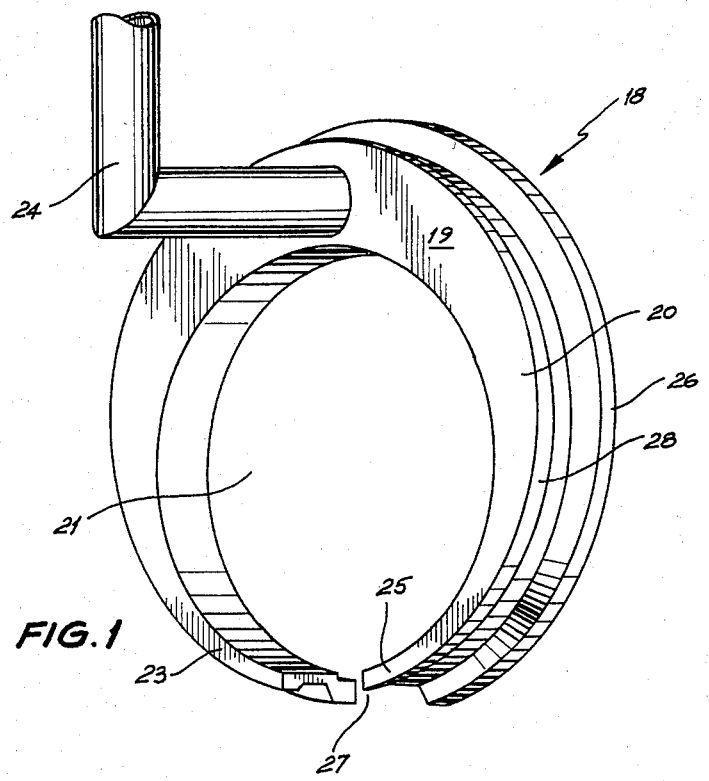
Figure 2:
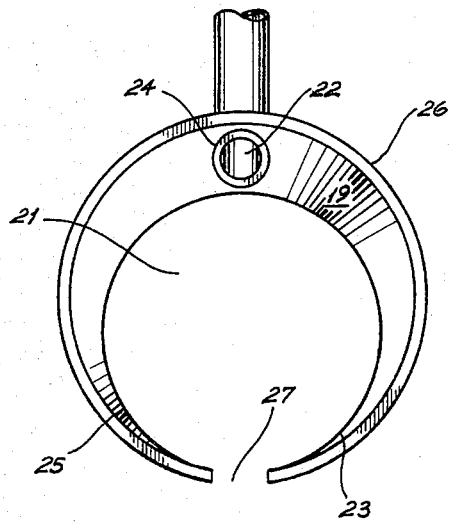
Figure 3:
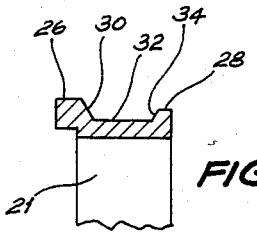
Figure 4:
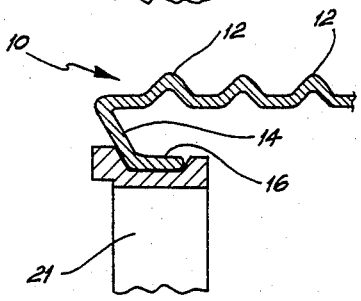
Figure 5:
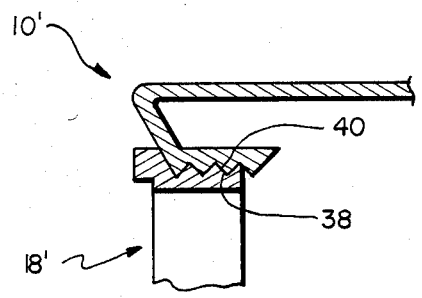

In order that the invention may be more readily understood and put into practical effect reference will now be made to the accompanying drawings, in which:

FIG. 1 is a rear perspective view of a pouring device according to one embodiment of the invention, FIG. 2 is a front elevation of the device shown in FIG. 1, FIG. 3 is a partial section of the device shown in FIGS. 1 and 2, FIG. 4 is a partial section through a portion of the device shown in FIGS. 1 and 2 seated in the outlet of a container, and FIG. 5 is a partial section of a second embodiment employing screw threads to attach the device in the outlet of a container.

The embodiment of the invention illustrated in the drawings is particularly useful for use on externally threaded upstanding outlets of 20 liter containers. A section through a portion 10 of the outer end of such an outlet is shown in FIG. 3. The portion 10 includes external screw threads 12 and an inturned outer portion consisting of an angled element 14 and a flat annular element 16. An internally threaded closure is screwed onto the outlet to close the container.

The pouring device 18 includes a body portion 19 the rear face 20 of which faces the interior of the container when the device is in position in the outlet of the container. An aperture 22 extends through the body portion 19 from the front face to the rear face 20.

An air flow tube 24 extends from the rear face 20 of the body portion 19 and is in communication with the aperture 22 so that air may flow from the exterior of the container to the interior of the container. As shown in FIG. 1 the air flow tube 24 extends above the top of the body portion 19. Although the air flow tube 24 is shown as L-shaped it may extend from the rear face 20 at an angle of about 45° to that face.

A pair of opposed legs 23 and 25 extend from the body portion 19 and are so shaped as to conform generally to the shape of the container outlet. The ends of the legs 23 and 25 are spaced apart at their ends remote from the body portion to provide a gap 27. The area between the legs 23 and 25 defines an outlet path 21 through which liquid from the container may flow. The periphery of the body portion 19 and the legs 23 and 25 are provided with spaced apart flanges 26 and 28 which are shown in detail in FIG. 3. Flange 26 has an inclined surface 30 which leads to a flat surface 32. Flange 28 also has an inclined surface 34 by which it is connected to the surface 32.

In use, the device 18 is pressed into the end portion 20 of the container outlet as shown in FIG. 4. Inclined surface 30 then abuts element 14 and the annular surface 32 abuts element 16. The device is held in position by the inclined surface 34 which abuts against the inner periphery of element 16. When in position the device may be rotated so that the air flow tube 24 is correctly located above the outlet 21.

It can be seen that once the device is sprung into position it will remain in location and that a closure may be readily screwed onto the external screwthreads 12 of the outlet. The pouring device therefore need not be touched by the user once it is fitted.

One of the problems associated with plastic pouring devices which are 'push fitted' into a container is that they lose their tolerance over a period of time due to 'creep' of the plastics material. This may be exacerbated by contact with liquids, so that the pourers do not remain a tight fit. If the pourer is allowed to dry, it will then be a sloppy fit, and may drop out of the container. The construction of the pouring device of this invention allows stresses to be spread over the flange of the device and resists the effects of 'creep'. An extension nozzle may be fitted to a container/pourer device arrangement of this invention. It may be screwthreaded internally at one end to be attached to outlet 10, and may be externally threaded at the other end to take the original cap for the container. Provision may be made to ensure proper return air flow through orifice 22 by creating communication to the orifice from the atmosphere.

The rim or external periphery of the device may be varied according to the shape and configuration of the outlet of the container in respect of which the pouring device is to be used. For example, the rim may be of sufficient width to carry a screwthread by means of which it may threadily engage the internally screwed outlet of the container. In the embodiment in FIG. 5 the device 18' is attached to the outlet 10' of a container by the use of screw threads. The device has threads 38 which engage the internal threads 40 of the container. In the case of a plastic container, the rim may be made rather narrow with a sharp edge which is adapted to engage into the plastic neck of the container outlet. Alternatively, the rim may have a pair of closely spaced sharp edges.

Various modifications may be made in detail of design and construction without departing from the scope and ambit of the invention.

I claim:

1. A pouring device adapted to be positioned in the outlet of a container, said device comprising:

(i) a body portion having a front face and a rear face arranged so that the rear face is directed towards the interior of the container when the device is in position, (ii) an aperture through the body portion from the front face to the rear face, (iii) an air flow tube extending from the rear face of the body portion and in communication with the aperture, the air flow tube having a free end disposed within the container so that air may flow through the tube from the exterior of the container to the interior thereof, said free end being located above the aperture when the container is in the pouring position, (iv) a pair of opposed legs extending from the body portion which generally conform to the shape of the container outlet but which are spaced apart at their ends remote from the body portion, the area between the legs defining an outlet path through which liquid from the container may flow, the cross-sectional area and the width of the legs progressively increasing lengthwise from their free ends so that when deformed inwardly to fit within the container outlet the bending stresses are evenly distributed therealong to resist creep.

2. A pouring device according to claim 1 wherein the aperture in the body portion and the outlet defined between the opposed legs are of circular cross-section.

3. A pouring device according to claim 1 wherein the body portion and the opposed legs are of circular configuration and the rim of the device has means for positively engaging the outlet of the container.

4. A pouring device according to claim 3 wherein the engaging means comprise a screwthread formed on the rim of the device.

5. A pouring device according to claim 3 wherein the engaging means is constituted by a pair of spaced apart flanges.

* * * * *